US011391269B2

(12) United States Patent
Tanner

(10) Patent No.: US 11,391,269 B2
(45) Date of Patent: Jul. 19, 2022

(54) HYBRID HYDRAULIC FRACTURING SYSTEM

(71) Applicant: Caterpillar Inc., Peoria, IL (US)

(72) Inventor: John M. Tanner, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 316 days.

(21) Appl. No.: 16/751,312

(22) Filed: Jan. 24, 2020

(65) Prior Publication Data

US 2021/0230987 A1 Jul. 29, 2021

(51) Int. Cl.

| | |
|---|---|
| ***E21B 43/26*** | (2006.01) |
| ***F04B 17/03*** | (2006.01) |
| ***F04B 17/05*** | (2006.01) |
| ***F04B 23/04*** | (2006.01) |
| ***F04B 17/00*** | (2006.01) |
| ***F04B 49/20*** | (2006.01) |

(52) U.S. Cl.

CPC ..... *F04B 17/00* (2013.01); *E21B 43/2607* (2020.05); *F04B 17/03* (2013.01); *F04B 17/05* (2013.01); *F04B 23/04* (2013.01); *F04B 49/20* (2013.01)

(58) Field of Classification Search

CPC ..... F04B 17/00; F04B 17/03; F04B 17/05; F04B 9/02; F04B 15/02; F04B 23/04; F04B 49/20; E21B 43/2607

USPC ..... 417/474

See application file for complete search history.

(56) References Cited

U.S. PATENT DOCUMENTS

| | | | | |
|---|---|---|---|---|
| 6,708,787 | B2 | 3/2004 | Naruse et al. | |
| 7,086,226 | B2 * | 8/2006 | Oguri | E02F 9/2246 60/436 |
| 7,900,724 | B2 | 3/2011 | Promersberger et al. | |
| 9,579,980 | B2 | 2/2017 | Cryer et al. | |
| 9,752,384 | B2 | 9/2017 | Gard | |
| 2013/0232964 | A1 * | 9/2013 | Nielsen | F04B 49/06 60/486 |
| 2017/0291712 | A1 * | 10/2017 | Himmelmann | B64D 27/10 |
| 2019/0162061 | A1 | 5/2019 | Stephenson | |

FOREIGN PATENT DOCUMENTS

| | | | |
|---|---|---|---|
| WO | 2015011223 | A3 | 1/2015 |
| WO | WO 2020/219091 | A1 * | 10/2020 |

* cited by examiner

*Primary Examiner* — Charles G Freay

(74) *Attorney, Agent, or Firm* — Calfee, Halter & Griswold LLP

(57) ABSTRACT

A hybrid hydraulic fracturing system having a driveline that includes an internal combustion engine having a crankshaft, a motor operatively coupled to a forward end of the crankshaft, a transmission operatively coupled to a rearward end of the crankshaft, a driveshaft operatively coupled to the transmission, and a fracturing pump operatively coupled to the driveshaft. The system also includes a power source electrically coupled to the motor for supplying power to the motor and a controller configured to power condition the driveline by operating the driveline in a first mode in response to a load change resulting in an increased power demand on the driveline, where the first mode includes providing torque from the internal combustion engine to drive the fracturing pump and selectively providing torque from the motor to a crankshaft of the internal combustion engine to assist the internal combustion engine in driving the fracturing pump.

20 Claims, 2 Drawing Sheets

HYBRID HYDRAULIC FRACTURING SYSTEM

TECHNICAL FIELD

This disclosure relates to a hydraulic fracturing system, and more particularly, to a hybrid hydraulic fracturing system.

BACKGROUND

Hydraulic fracturing operations may be used during well development in the oil and gas industry. For example, in formations in which oil or gas cannot be readily or economically extracted from the earth, a hydraulic fracturing operation may be performed. Such a hydraulic fracturing operation typically includes pumping large amounts of fracturing fluid at high pressure in the earth to induce cracks, thereby creating pathways via which the oil and gas may flow. Fracturing fluid often contains water, sand, and other additives and is pumped downhole by the hydraulic fracturing pump at a sufficient pressure to cause fractures and fissures to form within the well.

The fracturing pump in a fracturing operation is typically driven by a diesel, internal combustion engine. The diesel powered engine is responsive enough to provide the necessary transient power during fracturing operations. Utilizing diesel power for fracturing, however, can be expensive. Although natural gas engines are a cheaper option for performing fracturing operations, the natural gas engines tend to have a slower response time when the hydraulic fracturing rigs have fluctuating load demands. Accordingly, a system is desired that can leverage the lower cost power generation of gas engines, but also have the transient capability to reduce overall ownership costs and operation costs of hydraulic fracturing rigs.

WO2015011223 to Sepulveda discloses a drive for providing a high drive dynamic with high drive outputs to a pneumatic, hydraulic, or electrical machine (e.g. pump, fan, compressor) during a gas and/or oil recovery. The drive includes at least one steady-state gas engine with a low load-switching capacity, a first electric motor connected in series or parallel to the gas engine, an energy store is paired with the electric motor, and another electric motor which functions as a generator is coupled to the gas engine. The second electric motor is mechanically coupled to the gas engine and electrically coupled to the first electric motor.

SUMMARY

In accordance with one aspect of the present disclosure, a hybrid hydraulic fracturing system includes a driveline having an internal combustion engine with a crankshaft, a motor operatively coupled to a forward end of the crankshaft, a transmission operatively coupled to a rearward end of the crankshaft, a driveshaft operatively coupled to the transmission, and a fracturing pump operatively coupled to the driveshaft. The system also includes a power source electrically coupled to the motor for supplying power to the motor and a controller configured to power condition the driveline by operating the driveline in a first mode in response to a load change resulting in an increased power demand on the driveline, where the first mode includes providing torque from the internal combustion engine to drive the fracturing pump and selectively providing torque from the motor to a crankshaft of the internal combustion engine to assist the internal combustion engine in driving the fracturing pump.

In accordance with another aspect of the present disclosure, a method of power conditioning in a hydraulic fracturing system having a fracturing pump includes providing a motor operatively connected to a power source and operating a driveline of the hydraulic fracturing system in a first mode in response to a load change resulting in an increased power demand on the driveline. The first mode includes driving the fracturing pump with an internal combustion engine and selectively providing torque from the motor to a crankshaft of the internal combustion engine to assist the internal combustion engine in driving the fracturing pump, wherein the power source provides power to the motor.

BRIEF DESCRIPTION OF THE DRAWINGS

Further features and advantages will be evident from the following illustrative embodiment which will now be described, purely by way of example and without limitation to the scope of the claims, and with reference to the accompanying drawing, in which:

DETAILED DESCRIPTION

While the present disclosure describes certain embodiments of a hybrid hydraulic fracturing system, the present disclosure is to be considered exemplary and is not intended to be limited to the disclosed embodiments. Also, certain elements or features of embodiments disclosed herein are not limited to a particular embodiment, but instead apply to all embodiments of the present disclosure.

Figure 1:
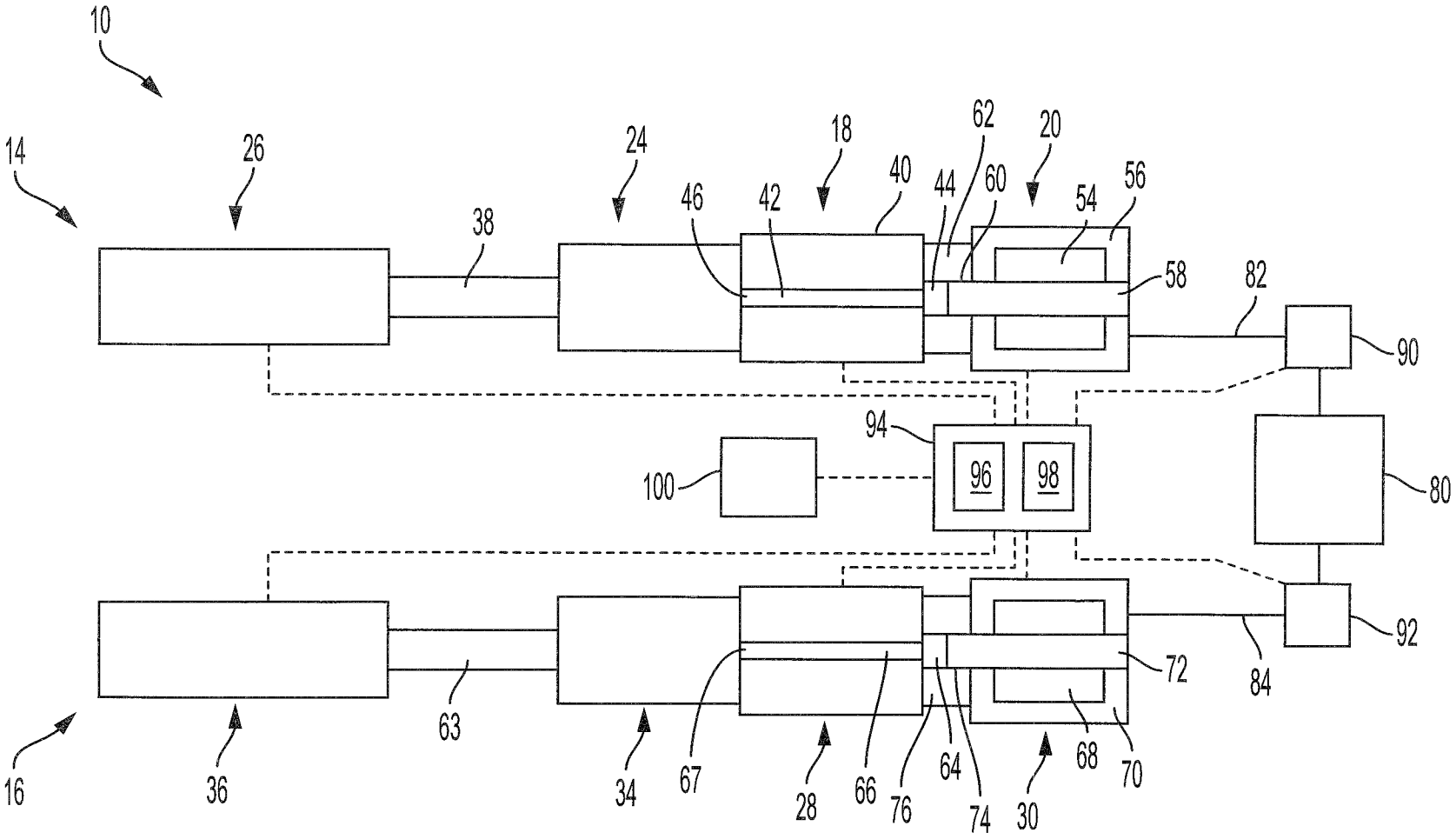
FIG. 1 is a schematic representation of an exemplary embodiment of a hybrid hydraulic fracturing system according to the present disclosure.

FIG. 1 illustrates an exemplary embodiment of hybrid hydraulic fracturing system 10. In the illustrated embodiment, the hybrid hydraulic fracturing system 10 is a parallel system having a first driveline 14 and a second driveline 16 arranged in parallel with the first driveline 14. The second driveline 16 may be identical to the first driveline 14 or may include one or more similar or the same components. In other embodiments, however, the hybrid hydraulic fracturing system 10 may not be a parallel system or may include more or less than two drivelines.

In the exemplary embodiment, the first driveline 14 includes a first internal combustion engine 18, a first power source 20, a first transmission 24, and a first fracturing pump 26 arranged in series. In the illustrated embodiment, the second driveline 16 includes the same components as the first driveline 14. Thus, the second driveline 16 includes a second internal combustion engine 28, a second power source 30, a second transmission 34, and a second fracturing pump 36 arranged in series. The description of the components of the first driveline 14 applies equally to the second driveline 16. In other embodiments, however, the second driveline 16 may include one or more different components from the first driveline 14.

The first driveline 14 is configured such that the first fracturing pump 26 is driven by a first driveshaft 38 which is driven by the first internal combustion engine 18 and the first motor 20 via the first transmission 24. The components of the first driveline 14 are arranged in series such that the first motor-generator 20 is operatively connected to the front of the first internal combustion engine 18, the first transmission 24 is operatively connected to the rear of the first internal combustion engine 18, and the first driveshaft 38 acts as an output shaft to operatively connect the first fracturing pump 26 to the first transmission 24.

The first internal combustion engine 18 may be configured in a variety of ways. Any suitable internal combustion engine 18 capable of driving the first fracturing pump 26 during a fracturing operation may be used. Suitable internal combustion engines may include diesel, gaseous (e.g., natural gas), gasoline, or dual fuel engines. In one exemplary embodiment, the first internal combustion engine 18 is a natural gas-fueled engine. The size and configuration of the first internal combustion engine 18 may also vary in different embodiments. For example, the displacement of the internal combustion engine 18 may vary and the internal combustion engine 18 may be a V-type, a rotary type, an in-line type, or other types known in the art. The first internal combustion engine 18 includes an engine block 40 and a first crankshaft 42 configured for rotation therein. The first crankshaft 42 includes a forward end 44 and a rearward end 46.

The first fracturing pump 26 may be configured in a variety of ways. In the illustrated embodiment, the first fracturing pump 26 may be a positive displacement reciprocating pump, a centrifugal pump, a rotary pump or other pump types that are capable of flowing water or water with additives such as proppant or chemicals. In some embodiments, first fracturing pump 26 is capable of flowing 1200 gal/minute or more and/or is capable of 15,000 psi output fluid pressure or greater.

The first transmission 24 may be configured in a variety of ways. For example, the size and type of the transmission may vary in different applications. Any suitable transmission for the specific embodiment of the first driveline 14 may be used depending on the required speed and torque for driving the first fracturing pump 26. Suitable transmission types may include, but not be limited to, planetary, countershaft, hydrostatic, or continuously variable transmissions.

The first motor 20 may be configured in a variety of ways. Any suitable electric motor capable of driving or assisting the first internal combustion engine 18 in driving the first fracturing pump 26 may be used. The first motor 20 may be a motor, a single integrated motor and generator, or a separate motor and a separate generator collectively referred to herein as a motor. In one exemplary embodiment, the first motor is an induction motor. The first motor 20 may operate over a large speed range. In one exemplary embodiment, the first motor 20 is able to operate in a speed range from 0-2100 rpm. In another exemplary embodiment, a gearbox (not shown) is operatively coupled between the first internal combustion engine 18 and the first motor 20. The gearbox (not shown) may be operatively coupled between the first internal combustion engine 18 and the first motor 20 in a conventional manner. With the use of the gearbox, the first motor 20 is able to operate in a speed range from 0-700 rpm or greater.

The first motor 20 is mechanically coupled to the forward end 44 of the first crankshaft 42. In particular, the first motor 20 includes a first rotor 54 rotatably mounted within a first stator 56. The first rotor 54 includes a first rotor shaft 58 having a first end 60. The first end 60 of the first rotor shaft 58 is mechanically coupled to the forward end 44 of the first crankshaft 42 for rotation therewith. The first end 60 of the first rotor shaft 58 may be mechanically coupled to the forward end 44 of the first crankshaft 42 in any suitable manner. In the illustrated embodiment, the forward end 44 of the first crankshaft 42 include a gear, damper, or the structure to which a hub 62 is mechanically attached, such as by bolting. The first end 60 of the first rotor shaft 58 is mechanically attached to the hub 62 for rotation therewith in any suitable manner, such as for example, by a keyed, interference fit.

Similarly, the second driveline 16 is configured such that the second fracturing pump 36 is driven by a second driveshaft 63 which is driven by the second internal combustion engine 28 and the second motor 30 via the second transmission 34. The second motor 30 is mechanically coupled to a forward end 64 of a second crankshaft 66 of the second internal combustion engine 28 and the second transmission is operatively coupled to a rearward end 67 of the second crankshaft 66. The second motor 30 includes a second rotor 68 rotatably mounted within a second stator 70. The second rotor 68 includes a second rotor shaft 72 having a first end 74. The first end 74 of the second rotor shaft 72 is mechanically coupled to the forward end 64 of the second crankshaft 66 for rotation therewith. The first end 74 of the second rotor shaft 72 may be mechanically coupled to the forward end 64 of the second crankshaft 66 in any suitable manner. In the illustrated embodiment, the forward end 64 of the second crankshaft 66 include a gear, damper, or the structure to which a second hub 76 is mechanically attached, such as by bolting. The first end 74 of the second rotor shaft 72 is mechanically attached to the second hub 76 for rotation therewith in any suitable manner, such as for example, by a keyed, interference fit.

The hybrid hydraulic fracturing system 10 also includes a power source 80 that is electrically connected to the first motor 20 by first electrical lines 82 and is electrically connected to the second motor 30 by second electrical lines 84. The power source 80 may be configured in a variety of ways. Any device capable of providing electrical power to the first motor 20 and the second motor 30 may be used. For example, the power source may be an energy storage device, such as for example, one or more DC batteries. The power source may also be generator, grid power, facility power, or other suitable power source.

The hybrid hydraulic fracturing system 10 also includes a first bi-directional rectifier-inverter 90 (e.g., a variable frequency drive) associated with the first motor 20 and a second bi-directional rectifier-inverter 92 associated with the second motor 30. The first bi-directional rectifier-inverter 90 is electrically connected to the first electrical lines 82 between the energy storage device 80 and the first motor 20 and the second bi-directional rectifier-inverter 92 is electrically connected to the second electrical lines 84 between the energy storage device 80 and the second motor 30.

The first bi-directional rectifier-inverter 90 and the second bi-directional rectifier-inverter 92 are configured to convert the DC current from the energy storage device 80 to AC current for deliver to the first motor 20 and the second motor 30, respectively, when the first motor 20 and the second motor 30 are acting in a motor mode. The first bi-directional rectifier-inverter 90 and the second bi-directional rectifier-inverter 92 are also configured to convert AC current generated by the first motor 20 and the second motor 30, respectively, when the first motor 20 and the second motor 30 are in a generator mode, for storage in the energy storage device 80.

The hybrid hydraulic fracturing system 10 may include a control system 94 that is configured to control and monitor the operation of hybrid hydraulic fracturing system 10. The control system 94 may be communicatively coupled to various components of the hybrid hydraulic fracturing system 10 as showed by dashed lines in FIG. 1. The control system 94 may be configured in a variety of ways. In the illustrated embodiment, the control system 94 includes a controller 96 and a memory 98. The controller 96 may embody a single microprocessor or multiple microprocessors configured to receive signals from the various components of the hybrid hydraulic fracturing system 10. A person of ordinary skill in the art will appreciate that the control system 94 may additionally include other components and may also perform other functions not described herein. The controller 96 may also be configured to receive inputs from an operator via one or more operator controls 100.

The memory 98 may include information regarding one or more parameters of the hybrid hydraulic fracturing system 10. Further, the controller 96 may be configured to refer to the information stored in the memory 98. The memory 98 may also be configured to store various information determined by the controller 96. In some embodiments, the memory 98 may be integral to the controller 96. The memory 98 may be a read only memory (ROM) for storing a program or programs, a random access memory (RAM) which serves as a working memory area for use in executing the program(s) stored in the memory 98, or a combination thereof. Alternatively, the memory 98 may be external to the controller 96 and/or the control system 94.

The control system 94 may be used to operate the hybrid hydraulic fracturing system 10 in different operating modes. The specific programming of the control system 94 and the controller 96 is within the understanding of those skilled in the art, and a detailed discussion of the programming methods is not provided herein. The controller 96 may be communicatively coupled to various portions of the hybrid hydraulic fracturing system 10 to send signals to, and receive signals from, those portions.

The controller 96 is configured to operate the hybrid hydraulic fracturing system 10 in a first mode in which, if speed or torque assistance is needed by the first internal combustion engine 18 and/or the second internal combustion engine 28 during operation of the fracturing pumps 26, 36, the control system 94 senses the need and activates the first motor 20 to selectively provide additional torque to the first crankshaft 42 of the first internal combustion engine 18 and/or activates the second motor 30 to selectively provide additional torque to the second crankshaft 66 of the second internal combustion engine 28. The first mode is considered a motor mode where additional load is provided by the motors 20, 30 to operate the fracturing pumps 26, 36. Either or both of the first driveline 14 and the second driveline 16 may operate in the first mode at a given time.

The controller 96 is also configured to operate the hybrid hydraulic fracturing system 10 in a second mode in which, if the speed or torque provided by the first internal combustion engine 18 and/or the second internal combustion engine 28 is too high during operation of the fracturing pumps 26, 36, the control system 94 senses it and activates the first motor 20 in a generating mode to selectively provide braking to the first crankshaft 42 of the first internal combustion engine 18 and/or activates the second motor 30 in a generating mode to selectively provide braking to the second crankshaft 66 of the second internal combustion engine 28. The second mode is considered a brake mode where additional load is removed by the motors 20, 30. During the second mode, the power generated by the motors 20, 30 may be sent to the energy storage device 80 for storage. Either or both of the first driveline 14 and the second driveline 16 may operate in the second mode at a given time.

The controller 96 is also configured to operate the hybrid hydraulic fracturing system 10 in a third mode in which one or both of the motors 20, 30 are not adding torque nor braking load from the corresponding internal combustion engines 18, 28. For example when the first driveline 14 is operated in the third mode, the first rotor 54 of the first motor 20 is rotating with the first crankshaft 42, but the first motor 20 not being excited or an open circuit is created such that the first motor 20 does not provide torque assist or braking to the first internal combustion engine 18. Either or both of the first driveline 14 and the second driveline 16 may operate in the third mode at a given time.

INDUSTRIAL APPLICABILITY

The disclosed hybrid hydraulic fracturing system 10 may be used in a wide variety of fracturing applications. While the exemplary embodiments of the hybrid hydraulic fracturing system 10 are illustrated as a dual driveline, parallel fracturing system, it will be understood that inventive aspects of the disclosed hybrid hydraulic fracturing system 10 may be used in hybrid hydraulic fracturing systems having more than or less than two drivelines and other than parallel arrangements.

In the illustrated embodiment, the hybrid hydraulic fracturing system 10 utilizes gaseous fueled engines (e.g. natural gas engines). Natural gas engines, however, tend to be less responsive than, for example, diesel engines. Thus, a natural gas fueled engine may not be able to sufficiently respond to transient load conditions during a fracturing operation. The disclosed hybrid hydraulic fracturing system 10 operatively couples a motor to each internal combustion engine to power condition the hybrid hydraulic fracturing system 10. Power condition, as used in this disclosure refers to providing load assistance and/or load braking when needed. For example, the system may be configured to power condition the first driveline by operating in the first mode in response to a load change that results in an increased power demand on the first driveline. Thus, the system may provide torque from the first internal combustion engine to drive the first fracturing pump and selectively provide additional torque from the first motor to the first crankshaft of the first internal combustion engine to assist the first internal combustion engine in driving the first fracturing pump. The system may operate the second driveline in the first mode in the same way.

Figure 2:
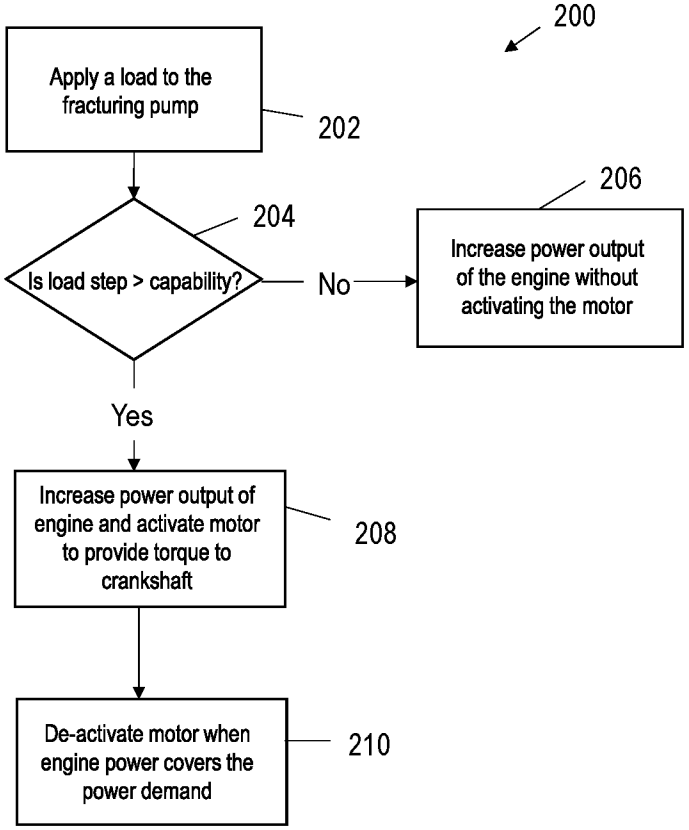
FIG. 2 is a flowchart of an exemplary method of power conditioning in the hybrid hydraulic fracturing system of FIG. 1 when additional power is needed.

FIG. 2 illustrates an exemplary method 200 of power conditioning the hybrid hydraulic fracturing system 10 when additional power is needed. The method 200 includes the step 202 of applying a load to the fracturing pump 26 of the hybrid hydraulic fracturing system 10 (i.e., the power demand to the system). The hybrid hydraulic fracturing system 10, in step 204, is then configured to determine if the load step (i.e., the power demand) is greater than the capability of the internal combustion engine 18 to respond by providing the additional power in a required time (i.e., provide a transient response). If the load step is not greater than the capability of the internal combustion engine 18 to respond, then at step 206, the power output of the internal combustion engine 18 is increased without activating the motor 20. If, however, the load step is greater than the capability of the internal combustion engine 18 to respond, then, at step 208, in conjunction with increasing the power output of the internal combustion engine 18, the motor 20 is activated to provide additional power to the hybrid hydraulic fracturing system 10 by providing torque to the crankshaft 42 of the internal combustion engine 18. Then, at step 210, when the engine power has increased to cover the power demand of the hybrid hydraulic fracturing system 10, the motor 20 is deactivated to remove the additional power the motor 20 is providing via the torque on the crankshaft 42.

The system may be configured to power condition the first driveline by operating in the second mode in response to a load change that results in a decreased power demand on the first driveline. Thus, the system may provide torque from the first internal combustion engine to drive the first fracturing pump and selectively provide braking from the first motor to the first crankshaft of the first internal combustion engine to reduce the speed of the first fracturing pump. The system may operate the second driveline in the second mode in the same way.

Figure 3:
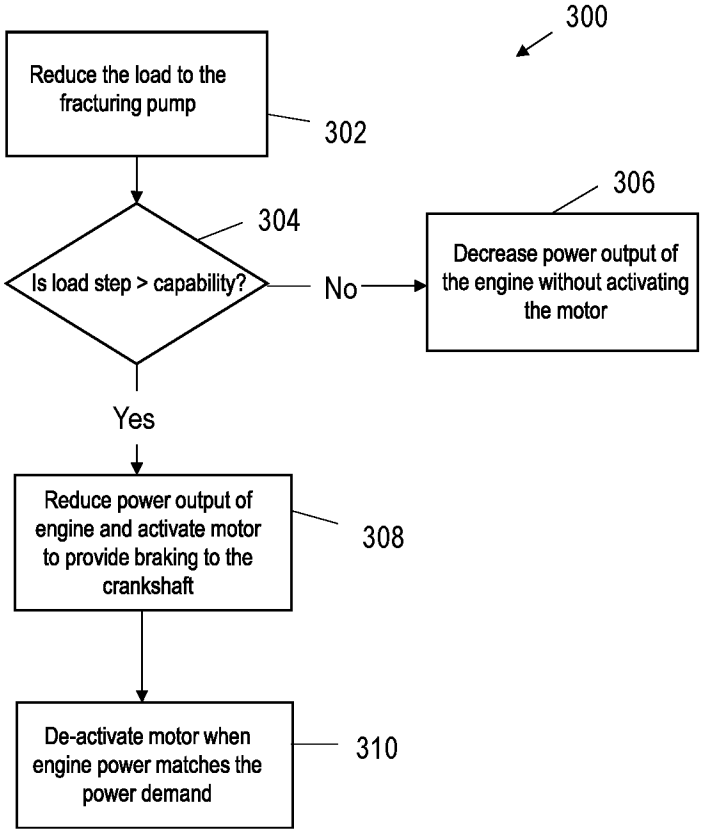
FIG. 3 is a flowchart of an exemplary method of power conditioning in the hybrid hydraulic fracturing system of FIG. 1 when reduced power is needed.

FIG. 3 illustrates an exemplary method 300 of power conditioning the hybrid hydraulic fracturing system 10 when reducing power is needed. The method 300 includes the step 302 of reducing the load to the fracturing pump 26 of the hybrid hydraulic fracturing system 10 (i.e., the power demand to the system). The hybrid hydraulic fracturing system 10, in step 304, is then configured to determine if the load step (i.e., the power demand) is less than the capability of the internal combustion engine 18 to respond by providing reducing power in a required time (i.e., provide a transient response). If the load step is not greater than the capability of the internal combustion engine 18 to respond, then at step 306, the power output of the internal combustion engine 18 is decreased without activating the motor 20. If, however, the load step is greater than the capability of the internal combustion engine 18 to respond, then, at step 308, in conjunction with reducing the power output of the internal combustion engine 18, the motor 20 is activated to provide braking to the hybrid hydraulic fracturing system 10 by absorbing power from the system via the crankshaft 42. The motor 20 may act as a generator during braking to generate power that can be send to the power source 80 for storage or use. Then, at step 310, when the engine power has decreased to match the power demand of the hybrid hydraulic fracturing system 10, the motor 20 is deactivated to remove the braking the motor 20 is providing.

Each driveline of the hybrid hydraulic fracturing system 10 may operate independently of the other drivelines such that a first driveline may be operating in one mode while one or more of the other drivelines is operating in a different mode. In this way, the motors can quickly respond to transient conditions by providing additional torque or braking excess load where the natural gas-fueled engine may not be able to.

In the illustrated embodiment, the motors are operatively coupled to the forward end of each engine such that components of each driveline are arranged in series. Having the motors operatively coupled to the front of each engine allows the motors to provide the desired torque assistance and load braking while not requiring modification to the coupling between the engine, the transmission, the driveshaft, and the fracturing pump.

Further, the motors are electrically coupled to a power source to both receive power from the power source when required, such as for example, in the first mode, and generate power to be utilized by the power source, such as for example, to store for future use or be used by some other power consumer coupled to the power source.

While the present disclosure has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the present disclosure, in its broader aspects, is not limited to the specific details and illustrative examples shown and described. Accordingly, departures may be made from such details without departing from the spirit or scope of Applicant's general disclosure herein.

LIST OF ELEMENTS

| Element Number | Element Name |
|---|---|
| 10 | hybrid hydraulic fracturing system |
| 14 | first driveline |
| 16 | second driveline |
| 18 | first internal combustion engine |
| 20 | first motor |
| 24 | first transmission |
| 26 | first fracturing pump |
| 28 | second internal combustion engine |
| 30 | second motor |
| 34 | second transmission |
| 36 | second fracturing pump |
| 38 | first driveshaft |
| 40 | engine block |
| 42 | first crankshaft |
| 44 | forward end |
| 46 | rearward end |
| 54 | first rotor |
| 56 | first stator |
| 58 | first rotor shaft |
| 60 | first end |
| 62 | hub |
| 63 | second driveshaft |
| 64 | forward end |
| 66 | second crankshaft |
| 67 | rearward end |
| 68 | second rotor |
| 70 | second stator |
| 72 | second rotor shaft |
| 74 | first end |
| 76 | second hub |
| 80 | power source |
| 82 | first electrical lines |
| 84 | second electrical lines |
| 90 | first bi-directional rectifier-inverter |
| 92 | second bi-directional rectifier-inverter |
| 94 | control system |
| 96 | controller |
| 98 | memory |
| 100 | operator controls |
| 200 | method |
| 202 | step |
| 204 | step |
| 206 | step |
| 208 | step |
| 210 | step |
| 300 | method |
| 302 | step |
| 304 | step |
| 306 | step |
| 308 | step |
| 310 | step |

What is claimed is:

1. A hybrid hydraulic fracturing system, comprising:

a first driveline, comprising:

an internal combustion engine having a crankshaft;

a motor operatively coupled to a forward end of the crankshaft to rotate with the crankshaft;

a transmission operatively coupled to a rear end of the crankshaft;

a driveshaft operatively coupled to the transmission; and a fracturing pump operatively coupled to the driveshaft for rotation with the driveshaft;

a power source electrically coupled to the motor for supplying power to the motor; and a controller configured to power condition the first driveline by operating the first driveline in a first mode in response to a load change resulting in an increased power demand on the first driveline, wherein the first mode comprises:

providing torque from the internal combustion engine to drive the fracturing pump; and selectively providing torque from the motor to a crankshaft of the internal combustion engine to assist the internal combustion engine in driving the fracturing pump.

2. The hybrid hydraulic system of claim 1, wherein the controller is further configured to operate the first driveline in a second mode in response to a load change resulting in a decreased power demand on the first driveline wherein the internal combustion engine provides torque to drive the fracturing pump and the motor selectively applies braking to the crankshaft.

3. The hybrid hydraulic system of claim 2, wherein the motor provides electrical power to the power source when the first driveline is operating in the second mode.

4. The hybrid hydraulic system of claim 3, further comprising a rectifier-inverter associated with the motor and configured to convert AC power from the motor to DC power for utilization by the power source.

5. The hybrid hydraulic system of claim 1, further comprising a rectifier-inverter associated with the motor and configured to convert DC power from the power source to AC power for use by the motor.

6. The hybrid hydraulic system of claim 1, wherein the power source comprises one or more of a battery, facility power, grid power, or a generator.

7. The hybrid hydraulic system of claim 1, further comprising:

a second driveline, comprising:

a second internal combustion engine having a second crankshaft;

a second motor operatively coupled to a forward end of the second crankshaft to rotate with the second crankshaft;

a second transmission operatively coupled to a rearward end of the second crankshaft;

a second driveshaft operatively coupled to the second transmission; and a second fracturing pump operatively coupled to the second driveshaft for rotation with the second driveshaft, wherein the controller is configured to power condition the second driveline by operating the second driveline in a first mode in response to a load change resulting in an increased power demand on the second driveline, wherein the first mode comprises:

providing torque from the second internal combustion engine to drive the second fracturing pump; and selectively providing torque from the second motor to the second crankshaft of the second internal combustion engine to assist the second internal combustion engine in driving the second fracturing pump.

8. The hybrid hydraulic system of claim 7, wherein the controller is configured to operate the second driveline in a second mode in response to a load change resulting in a decreased power demand on the second driveline wherein the second internal combustion engine selectively provides torque to drive the second fracturing pump and the second motor selectively applies braking to the second crankshaft.

9. The hybrid hydraulic system of claim 8, wherein the controller controls the first driveline independently of the second driveline.

10. The hybrid hydraulic system of claim 8, wherein the second motor provides electrical power to the power source when the second driveline is operating in the second mode.

11. The hybrid hydraulic system of claim 10, further comprising a second rectifier-inverter associated with the second motor and configured to convert AC power from the second motor to DC power for utilization by the power source.

12. The hybrid hydraulic system of claim 7, further comprising a second rectifier-inverter associated with the second motor and configured to convert DC power from the power source to AC power for use by the second motor.

13. The hybrid hydraulic system of claim 1, wherein the internal combustion engine is a gaseous-fuelled engine.

14. A method of power conditioning in a hydraulic fracturing system having a fracturing pump, the method comprising:

providing a motor operatively connected to a power source;

operating a first driveline of the hydraulic fracturing system in a first mode in response to a load change resulting in an increased power demand on the first driveline, comprising:

driving the fracturing pump with an internal combustion engine; and selectively providing torque from the motor to a crankshaft of the internal combustion engine to assist the internal combustion engine in driving the fracturing pump, wherein the power source provides power to the motor.

15. The method of claim 14, further comprising:

operating the first driveline of the hydraulic fracturing system in a second mode in response to a load change resulting in a decreased power demand on the first driveline, comprising:

driving the fracturing pump with the internal combustion engine; and selectively braking the crankshaft of the internal combustion engine with the motor to reduce a speed of the fracturing pump, wherein the motor provide power to the power source.

16. The method of claim 15, wherein providing power to the power source further comprises generating AC power, converting the AC power to DC power, and storing the power in the power source.

17. The method of claim 14, wherein the hydraulic fracturing system includes a second driveline having a second fracturing pump driven by a second internal combustion engine, the method further comprising:

providing a second motor operatively connected to the power source;

operating the second driveline of the hydraulic fracturing system in a first mode in response to a load change resulting in an increased power demand on the second driveline, comprising:

driving the second fracturing pump with the second internal combustion engine; and selectively providing torque from the second motor to a second crankshaft of the second internal combustion engine to assist the second internal combustion engine in driving the second fracturing pump, wherein the power source provides power to the second motor.

18. The method of claim 17, wherein a controller operates the first driveline independently of the second driveline.

19. The method of claim 17, further comprising:

operating the second driveline of the hydraulic fracturing system in a second mode in response to a load change resulting in a decreased power demand on the second driveline, comprising:

driving the second fracturing pump with the second internal combustion engine; and selectively braking the second crankshaft of the second internal combustion engine with the second motor to reduce a speed of the second fracturing pump, wherein the second motor provides power to the power source.

20. The method of claim 19, wherein braking the second crankshaft of the second internal combustion engine with the second motor further comprises generating power with the second motor and storing the power in the power source.

* * * * *